United States Patent [19]

Zielinski

[11] 4,165,039

[45] Aug. 21, 1979

[54] GAS APPLIANCE RETROFIT ORIFICE

[76] Inventor: John P. Zielinski, 9724 Laurence Ave., Allen Park, Mich. 48101

[21] Appl. No.: 862,018

[22] Filed: Dec. 19, 1977

[51] Int. Cl.[2] ..... F23C 5/00

[52] U.S. Cl. ..... 239/600

[58] Field of Search ..... 431/154; 285/189, 328; 239/390, 391, 436, 550, 589, 600

[56] References Cited

U.S. PATENT DOCUMENTS

| | | | |
|---|---|---|---|
| 1,403,915 | 1/1922 | Polhemus | 239/600 X |
| 2,249,398 | 7/1941 | Ploch | 239/600 |
| 3,597,135 | 8/1971 | Kweller et al. | 239/550 X |
| 3,781,941 | 1/1974 | MacFarland | 285/328 X |

FOREIGN PATENT DOCUMENTS

| | | | |
|---|---|---|---|
| 1288648 | 9/1972 | United Kingdom | 285/328 |

*Primary Examiner*—Robert B. Reeves
*Assistant Examiner*—Andres Kashnikow
*Attorney, Agent, or Firm*—Gifford, Chandler, VanOphem, Sheridan & Sprinkle

[57] ABSTRACT

A gas appliance retrofit drive orifice is provided for use in resizing the existing orifice in a gas burning appliance. The retrofit orifice comprises an elongated body having an enlarged diameter head formed on one axial end and a fluid passage formed axially through the body. The end of the elongated body opposite from the enlarged head forms a pilot section and is inserted into a receiving hole drilled in the existing orifice. A retention portion axially adjacent the head is substantially the same or slightly larger than the drilled receiving hole whereby upon driving the retrofit orifice into the receiving hole, the retention portion frictionally engages and secures the retrofit orifice to and fluidly coupled with the existing orifice.

3 Claims, 5 Drawing Figures

Fig-1
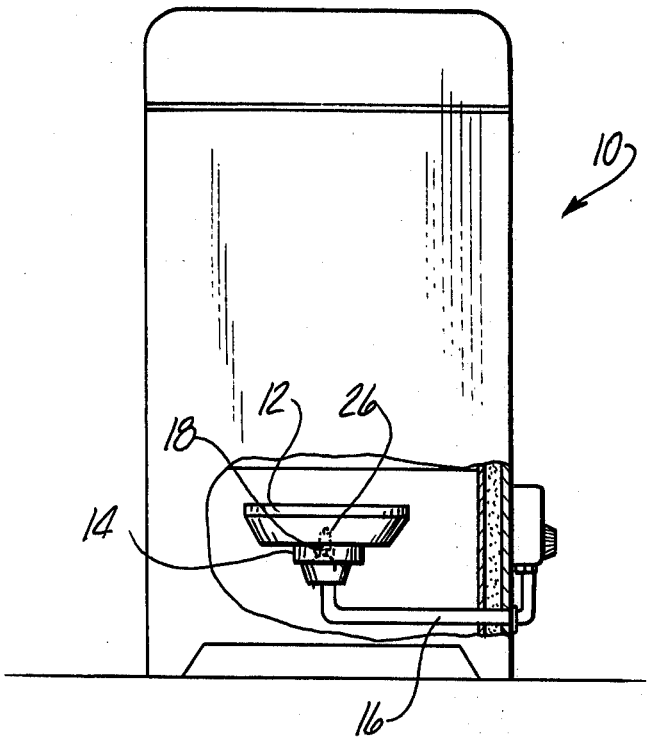
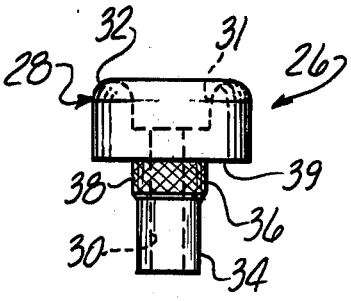
Fig-2
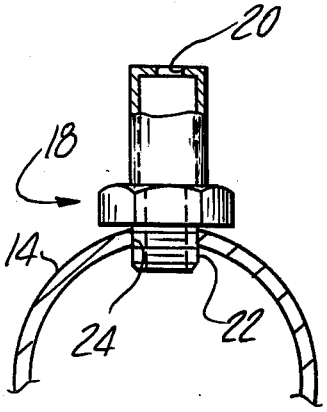
Fig-3
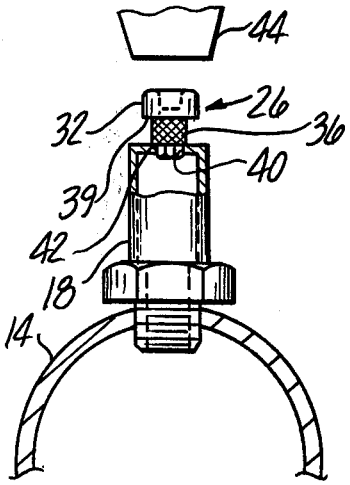
Fig-4
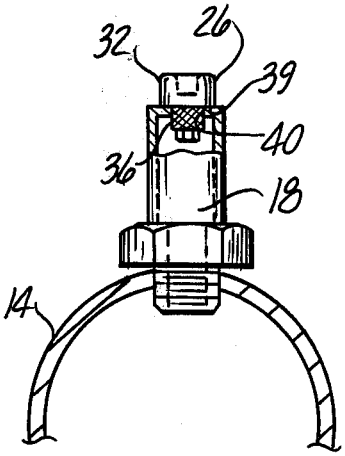
Fig-5

GAS APPLIANCE RETROFIT ORIFICE

BACKGROUND OF THE INVENTION

I. Field of the Invention

The present invention relates generally to gas appliances and, more particularly, to a retrofit drive orifice for use with such gas appliances.

II. Description of the Prior Art

Conventional gas appliances, for example, gas furnaces, water heaters and the like, include a burner coupled to a source of flammable gas, typically natural gas, via a manifold.

In order to limit or restrict the flow of gas through the manifold and to the burner, these previously known gas appliances have employed orifices attached to the manifold and having a restricted fluid passage through bore. In order to secure the orifice to the manifold, external threads are formed about one end of the orifice which threadably engage internal threads in a hole through the manifold.

This previously known means for attaching the orifice to the manifold, however, is disadvantageous when replacement and/or retrofit of the orifice is desired. Such replacement and/or retrofit of the orifice may be required, for example, when further restriction of the orifice is desired in order to reduce the fuel consumption of the gas appliance for energy conservation purposes. Many gas appliances, particularly gas furnaces, have oversized orifices which are wasteful of natural gas.

These previously known orifices for gas appliances, however, have not been produced with standard thread sizes. Consequently, it is rarely possible to merely unscrew the old orifice and to screw in a new orifice with the desired through bore. Moreover, when the old orifice is unscrewed, the seal between the orifice and manifold is broken and the new orifice oftentimes forms an inadequate seal with the manifold. An inadequate seal, in turn, results in gas leaks and the resultant safety hazard.

As a result of this lack of standardization for the orifice thread sizes, it has been the previously known practice when installing a new orifice into a gas appliance, to unscrew the old orifice and thereafter tap or thread a new hole corresponding to the thread size of the replacement orifice. This procedure, however, is disadvantageous in that it is time consuming, it requires special tools, and, therefore, it is expensive in labor cost.

SUMMARY OF THE PRESENT INVENTION

The present invention overcomes the above mentioned disadvantages by providing a retrofit drive orifice for gas appliances which can be driven or press fit into a drilled standard size hole in the existing orifice.

In brief, the retrofit orifice according to the present invention comprises an elongated and generally cylindrical body having an enlarged diameter head formed on one end. An axial through bore through the body, more restricted in cross-sectional area than the existing orifice, provides fluid communication from the manifold and into the burner as will become shortly apparent.

The retrofit orifice of the present invention includes a slightly enlarged diameter retention portion adjacent the head and knurled about its outer periphery. This attachment portion is preferably of a standard diameter regardless of the through bore size of the retrofit orifice.

The open end of the existing orifice is then drilled to a standard size receiving hole corresponding substantially to or slightly smaller than the diameter of the retention portion regardless of the through bore size of the retrofit orifice. The retrofit orifice is then simply installed in the existing orifice receiving hole by hitting the retrofit orifice with a hammer or the like so that the retention portion frictionally engages and secures the retrofit orifice to and fluidly coupled with the existing orifice.

BRIEF DESCRIPTION OF THE DRAWINGS

A better understanding of the present invention will be had on reference to the following detailed description when read in conjunction with the accompanying drawings, wherein like reference characters refer to like parts throughout the several views, and in which:

FIG. 1 is a partial sectional view showing a retrofit orifice according to the present invention installed in a gas appliance;

FIG. 2 is a plan view showing the retrofit orifice according to the present invention and enlarged for clarity; and FIGS. 3–5 are partial sectional side views illustrating the steps of installation for the retrofit orifice according to the present invention.

DETAILED DESCRIPTION OF THE PRESENT INVENTION

With reference to FIG. 1, a gas appliance 10 is thereshown which may be, for example, a furnace, water heater or the like. A burner 12 is mounted on a manifold 14 which, in turn, is connected to a source of flamable gas (not shown) via an appropriate conduit 16.

With reference now particularly to FIG. 3, it has been the previous practice to employ an orifice 18 having a through bore 20 for restricting the fluid flow through the manifold 14 and into the burner 12. These previously known orifices 18 include a threaded portion 22 which threadably engages a threaded hole 24 in the manifold 14 for securing the previously known orifice 18 to the manifold 14.

With reference now to FIG. 2, the retrofit orifice 26 according to the present invention comprises a body 28 which is generally cylindrical and elongated in shape. An axial through bore 30 through the body 28 having an enlarged diameter portion 31 at its upper end establishes restricted fluid communication through the body 28. The bore 30 is more restricted in cross-sectional area than the bore 20 of the existing orifice 18 which it retrofits or resizes in order to conserve fuel.

An enlarged head 32 is formed at one axial end of the body 28 while a reduced diameter pilot portion 34 is formed at the other end of the body 28 around the enlarged diameter portion 31 of the bore 30. The body 28 is preferably of one-piece construction.

A retention portion 36 is provided on the body 28 between the enlarged head 32 and the pilot portion 34. The retention portion 36 is larger in diameter than the pilot 34 but smaller in diameter than the enlarged head 32 and is preferably knurled as shown at 38 around its external surface for a reason to become hereinafter apparent. In addition, the junction of the retention portion 36 with the head 32 forms a radial annular abutment surface 39 on the inner or lower axial end of the head 32.

In order to install the retrofit orifice 26 in the existing orifice 18, the outwardly extending end of the existing orifice 18 is first drilled coaxially with its bore 20 to a standard and predetermined size hole as shown at 40 in FIG. 3. Moreover, the diameter of the hole 40 is substantially the same or slightly smaller than the diameter of the retrofit orifice retention portion 36. In addition, the diameters of both the retention portion 36 and the receiving hole 40 are fixed regardless of the size of the retrofit orifice bore 30 so that only a single drill will be required to connect the orifice 26 to the existing orifice 18 regardless of the fluid restriction provided by the retrofit orifice 26.

With reference now to FIGS. 4 and 5, the pilot 34 of the body 28 is positioned within the hole 40 until the retention portion 36 abuts against the hole 40 (FIG. 4). Since the hole 40 is the same or slightly less in diameter than the retention portion 36, the lower end 42 rests at the opening of the hole 40.

Thereafter, impact means 44, such as a hammer, are used to drive the retrofit orifice 26 into the drilled receiving hole 40 until the annular abutment surface 39 abuts the outer end of the existing orifice 18 and limits the axial travel of the retrofit orifice 26 as best shown in FIG. 5. In doing so, the retention portion 36 frictionally engages and secures the retrofit orifice 26 to the existing orifice 18 so that the retrofit orifice bore 30 is in fluid communication with the existing orifice bore 20. Moreover, the knurled external surface of the retention portion 36 bites into the existing orifice 18 which further insures a secure attachment of the retrofit orifice 26 to the existing orifice. However, a fluid leak between the retrofit orifice 26 and the existing orifice 18 does not present a safety hazard since the leak, if any, would occur within the burner 12 over the existing orifice 18. Lastly, the enlarged diameter portion 31 of the retrofit orifice bore 30 prevents unwanted additional fluid flow restriction of the retrofit orifice 26 in the event the head 32 is peened over when struck by the hammer 44.

It can, therefore, be seen that the retrofit drive orifice 26 according to the present invention achieves several advantages over the previously known means for resizing orifices for gas appliances. Most importantly, since the retention portion 36 is of the same diameter regardless of the cross-sectional area of the bore 30, only a single drill for drilling the hole 40 and a hammer are required for retrofitting the existing orifice 18 and removal of the existing orifice 18 is not required. Moreover, as previously stated, by retrofitting or resizing the existing orifice 18 with the retrofit orifice 26 having a more restricted cross-sectional area for the bore 30, the amount of gas consumed by the gas appliance 10 is accordingly reduced which results in energy conservation.

Having described my invention, however, many modifications thereto will become apparent to those skilled in the art to which it pertains without deviation from the spirit of the invention as defined by the scope of the appended claims.

I claim:

1. For use in conjunction with a gas appliance having a source of gas fluidly connected to burner means via an existing orifice in a manifold means, a retrofit orifice comprising:

an elongated body, said body having an enlarged annular head formed on one axial end thereof;

fluid passage means formed axially through said body, said fluid passage means comprising a throughbore formed axially through said body, said throughbore having an enlarged diameter portion through the enlarged head of the body whereby distortion of the enlarged head will not fluidly restrict the fluid passage means; and a cylindrical retention portion on said body axially adjacent said head, said retention portion having a diameter substantially the same or slightly larger than a hole formed in the existing orifice, the exterior surface of the retention portion being knurled whereby said retrofit orifice is securely attached to the existing orifice by driving said retrofit orifice into said existing orifice hole so that the exterior knurled surface of said retention portion frictionally engages and bites into said existing orifice to thereby fixedly attach said retrofit orifice to said existing orifice and so that said fluid passage means fluidly communicates with said manifold means via the existing orifice.

2. The invention as defined in claim 1 wherein the junction of the retention portion with the enlarged head forms an annular radial abutment surface on the inner axial end of the head and wherein said abutment surface abuts against the existing orifice upon attachment of the retrofit orifice with the existing orifice.

3. The invention as defined in claim 2 wherein said body includes a reduced diameter pilot at the end opposite from the head, said pilot portion being small in diameter than the retention portion.

* * * * *